US010953972B2

(12) United States Patent
Schroeder et al.

(10) Patent No.: US 10,953,972 B2
(45) Date of Patent: Mar. 23, 2021

(54) TROLLING MOTOR ASSEMBLY WITH DEPLOYMENT ASSISTANCE

(71) Applicant: NAVICO HOLDING AS, Egersund (NO)

(72) Inventors: Jeremy J. Schroeder, Sapulpa, OK (US); Peter Ver Brugge, Tulsa, OK (US)

(73) Assignee: NAVICO HOLDING AS, Egersund (NO)

( * ) Notice: Subject to any disclaimer, the term of this patent is extended or adjusted under 35 U.S.C. 154(b) by 0 days.

(21) Appl. No.: 16/247,990

(22) Filed: Jan. 15, 2019

(65) Prior Publication Data

US 2020/0223521 A1 Jul. 16, 2020

(51) Int. Cl.
*B63H 5/20* (2006.01)
*B63H 5/125* (2006.01)
(Continued)

(52) U.S. Cl.
CPC ..... *B63H 20/08* (2013.01); *B63H 20/007* (2013.01); *B63H 20/06* (2013.01)

(58) Field of Classification Search
CPC ..... B63H 20/007; B63H 20/02; B63H 20/06; B63H 20/08; B63H 20/10; B63H 20/106; B63H 20/12; B63H 20/14; B63H 20/16; B63H 2020/02; B63H 2020/08; B63H 2020/10; B63H 2020/103; B63H 2020/14; B63H 2020/145
(Continued)

(56) References Cited

U.S. PATENT DOCUMENTS 2,901,194 A * 8/1959 Shontz ..... B63H 20/36 248/642
4,708,670 A * 11/1987 Peters ..... B63H 20/007 248/642
(Continued)

FOREIGN PATENT DOCUMENTS

EP 1 891 461 B1 5/2014
WO WO 2013/126761 A1 8/2013
WO WO 2014/144471 A1 9/2014

OTHER PUBLICATIONS

MotorGuide X5 Foot-Operated Freshwater Trolling Motor; retrieved Jan. 14, 2019 from http://www.motorguide.com/store/product/x5.
(Continued)

*Primary Examiner* — Daniel V Venne
(74) *Attorney, Agent, or Firm* — Nelson Mullins Riley & Scarborough LLP

(57) ABSTRACT

A trolling motor assembly may be pivotable between a stowed position and a deployed position. The trolling motor assembly may include a trolling motor subassembly comprising a shaft and a motor coupled thereto. The subassembly may be pivotable about a base via a linkage. The linkage may include a first arm having a first end and a second end, wherein the first end of the first arm is coupled with the base, and the second end of the first arm is coupled with the shaft. A first biasing element may be coupled with the linkage so that the biasing element is configured to apply a first force to the linkage that biases the linkage in a raising direction from the stowed position in order to assist a user in deploying the trolling motor into the water.

20 Claims, 11 Drawing Sheets

(51) Int. Cl.
*B63H 20/08* (2006.01)
*B63H 20/06* (2006.01)
*B63H 20/00* (2006.01)

(58) Field of Classification Search
USPC ..... 440/6, 7, 53, 55, 56, 61 S, 61 T, 61 E, 440/61 F, 62, 63, 64, 65, 75; 248/642
See application file for complete search history.

(56) References Cited

U.S. PATENT DOCUMENTS

| | | | | |
|---|---|---|---|---|
| 6,054,831 | A | 4/2000 | Moore et al. | |
| 6,447,347 | B1 | 9/2002 | Steinhauser | |
| 6,507,164 | B1 | 1/2003 | Healey et al. | |
| 6,524,144 | B2 | 2/2003 | Pasley | |
| 6,661,742 | B2 | 12/2003 | Hansen | |
| 6,678,589 | B2 | 1/2004 | Robertson et al. | |
| 6,870,794 | B2 | 3/2005 | Healey | |
| 6,902,446 | B1 | 6/2005 | Healey | |
| 6,919,704 | B1 | 7/2005 | Healey | |
| 7,004,804 | B2 * | 2/2006 | Bernloehr ..... | B63H 20/007 248/642 |
| 7,195,526 | B2 * | 3/2007 | Bernloehr ..... | B63H 20/007 248/642 |
| 7,303,595 | B1 | 12/2007 | Janitz | |
| 7,538,511 | B2 | 5/2009 | Samek | |
| D594,034 | S | 6/2009 | Bernloehr et al. | |
| 7,722,417 | B2 | 5/2010 | Bernloehr et al. | |
| 8,106,617 | B1 | 1/2012 | Holley | |
| 8,305,844 | B2 | 11/2012 | DePasqua | |
| 8,645,012 | B2 | 2/2014 | Salmon et al. | |
| 8,761,976 | B2 | 6/2014 | Salmon et al. | |
| 8,814,129 | B2 | 8/2014 | Todd et al. | |
| 8,879,359 | B2 | 11/2014 | DePsqua | |
| 9,127,707 | B1 | 9/2015 | Huntley | |
| 9,132,900 | B2 | 9/2015 | Salmon et al. | |
| 9,160,210 | B2 | 10/2015 | Perry | |
| 9,162,743 | B2 | 10/2015 | Grace et al. | |
| 9,278,745 | B2 | 3/2016 | Kooi, Jr. et al. | |
| 9,290,256 | B1 | 3/2016 | Wireman et al. | |
| 9,676,462 | B2 | 6/2017 | Bernloehr et al. | |
| 2002/0102888 | A1 | 8/2002 | Pasley | |
| 2003/0191562 | A1 | 10/2003 | Robertson et al. | |
| 2003/0203684 | A1 | 10/2003 | Healey | |
| 2005/0255761 | A1 | 11/2005 | Bernloehr et al. | |
| 2006/0116031 | A1 | 6/2006 | Bernloehr et al. | |
| 2009/0037040 | A1 | 2/2009 | Salmon et al. | |
| 2009/0227158 | A1 | 9/2009 | Bernloehr et al. | |
| 2010/0116967 | A1 | 5/2010 | Todd et al. | |
| 2012/0014220 | A1 | 1/2012 | DePasqua | |
| 2012/0015566 | A1 | 1/2012 | Salmon | |
| 2012/0204467 | A1 | 8/2012 | Palmer et al. | |
| 2012/0232719 | A1 | 9/2012 | Salmon et al. | |
| 2013/0044569 | A1 | 2/2013 | DePasqua | |
| 2013/0215719 | A1 | 8/2013 | Betts et al. | |
| 2014/0203162 | A1 | 7/2014 | Logan | |
| 2014/0249698 | A1 | 9/2014 | Salmon et al. | |
| 2014/0269164 | A1 | 9/2014 | Betts et al. | |
| 2014/0277851 | A1 | 9/2014 | Grace et al. | |
| 2015/0016130 | A1 | 1/2015 | Davis et al. | |
| 2015/0063059 | A1 | 3/2015 | DePasqua | |
| 2015/0063060 | A1 | 3/2015 | DePasqua | |
| 2015/0151824 | A1 | 6/2015 | Wireman | |
| 2015/0298782 | A1 | 10/2015 | Bernloehr et al. | |
| 2015/0346729 | A1 | 12/2015 | Grace et al. | |
| 2016/0001865 | A1 | 1/2016 | Bernloehr et al. | |
| 2016/0016651 | A1 | 1/2016 | Anderson et al. | |

OTHER PUBLICATIONS

MotorGuide Xi5 Wireless Trolling Motor; retrieved Jan. 14, 2019 from http://www.motorguide.com/store/product/xi5.

Minn Kota Terrova Trolling Motor; retrieved Jan. 14, 2019 from https://minnkotamotorsjohnsonoutdoors.com/freshwater-trolling-motors/terrova?id=13266.

Minn Kota Ultrex Trolling Motor; retrieved Jan. 14, 2019 from https://minnkotamotors.johnsonoutdoors.com/cs/node/14591.

* cited by examiner

TROLLING MOTOR ASSEMBLY WITH DEPLOYMENT ASSISTANCE

FIELD OF THE INVENTION

Embodiments of the present invention relate generally to trolling motor assemblies and, more particularly, to systems, assemblies, and associated methods for assisting in deploying the trolling motor assembly.

BACKGROUND OF THE INVENTION

Trolling motors are often used during fishing or other marine activities. The trolling motors attach to the watercraft and propel the watercraft along a body of water. For example, trolling motors may provide secondary propulsion or precision maneuvering that can be ideal for fishing activities. The trolling motors, however, may also be utilized for the main propulsion system of watercraft. Accordingly, trolling motors offer benefits in the areas of ease of use and watercraft maneuverability, among other things. That said, further innovation with respect to the operation of trolling motors is desirable. Applicant has developed systems, assemblies, and methods detailed herein to improve capabilities of trolling motors.

BRIEF SUMMARY OF THE INVENTION

Some trolling motors are pivotable from a stowed position to a deployed position. In some situations, it may be difficult for a user to move the trolling motor from the stowed state the deployed state, such as due to the weight of the trolling motor housing and shaft. Thus, some embodiments of the present invention provide a mechanical assistance to help a user move the trolling motor from the stowed state to the deployed state.

In an example embodiment, a trolling motor assembly is provided including a trolling motor subassembly. The trolling motor subassembly includes a shaft comprising an axis, and a motor coupled with the shaft at a first end of the shaft. When attached to a watercraft on a body of water, the trolling motor subassembly is movable between a stowed position and a deployed position. The motor of the trolling motor subassembly is configured to be submerged in the body of water when the trolling motor subassembly is the deployed position and the motor of the trolling motor subassembly is configured to be out of the body of water when the trolling motor subassembly is in the stowed position. The trolling motor assembly also includes a base and a linkage coupling the trolling motor subassembly to the base. The linkage includes a first arm having a first end and a second end. The first end of the first arm is coupled with the base. The linkage also includes a first biasing element coupled with the linkage so that the first biasing element is configured to apply a first force to the linkage that biases the linkage in a raising direction from the stowed position.

In some example embodiments, when the base is coupled with a marine vessel and the trolling motor subassembly is in the stowed position, the shaft is generally horizontal, and when the base is coupled with the marine vessel and the trolling motor subassembly is in the deployed position, the shaft is generally vertical.

In some example embodiments, the trolling motor assembly also includes a second biasing element coupled with the linkage so that the second biasing element is configured to apply a second force to the linkage that biases the linkage to move the trolling motor subassembly toward the stowed position. In an example embodiment, the first biasing element and the second biasing element are coupled to form a bidirectional biasing structure. In an example embodiment, the linkage also includes a second arm and a third arm. The first arm is pivotably coupled at a first end with the base about a first axis and is pivotably coupled at a second end, opposite the first end, with the second arm about a second axis that is parallel to and displaced from the first axis. The second arm is pivotably coupled with the third arm about a third axis that is parallel to, but displaced from, the first and second axes. The third arm is pivotably coupled with the base about a fourth axis that is parallel to, but displaced from, the first, second, and third axes, and the second arm is coupled with the shaft so that the axis of the shaft is configured to remain in a fixed orientation with respect to a plane that includes the second axis and the third axis, thereby coupling the shaft to the first arm.

In some example embodiments, the second biasing element is coupled with the linkage so that the second biasing element is configured to apply the second force to the linkage only along a portion of a travel path of the trolling motor subassembly. In some example embodiments, the first biasing element is pivotably coupled with the first arm between the first and second axes and is pivotably coupled with the third arm between the third and fourth axes.

In some example embodiments, the trolling motor assembly also includes a spring arm that is pivotably coupled to the base about the fourth axis. The second biasing element is pivotably coupled with the spring arm about a fifth axis that is offset from the first, second, third, and fourth axes. The second biasing element is pivotably coupled with the third arm between the third and fourth axes. In some example embodiments, the first biasing element is slidably coupled with the third arm. In an example embodiment, the first biasing element is slidably coupled with the third arm via a pivotable pin that is slidable within a slot.

In some example embodiments, the second arm includes a trolling motor subassembly mount that pivotably and slidably receives the shaft of the trolling motor subassembly.

In some example embodiments, the second biasing element is a gas spring. In some example embodiments, the first biasing element is a gas spring.

In another example embodiment, a trolling motor mount for movably coupling a trolling motor subassembly to a marine vessel so that the trolling motor subassembly is movable between a stowed position and a deployed position is provided. A motor of the trolling motor subassembly is configured to be submerged in a body of water when the trolling motor subassembly is in the deployed position and the motor of the trolling motor subassembly is configured to be out of the body of water when the trolling motor subassembly is in the stowed position. The trolling motor includes a shaft having an axis. The trolling motor mount includes a linkage including a base, a first arm having a first end and a second end, a second arm, and a third arm. The first arm is pivotably coupled at the first end with the base about a first axis. The first arm is pivotably coupled at the second end with the second arm about a second axis that is parallel to and displaced from the first axis. The second arm is pivotably coupled with the third arm about a third axis that is parallel to, but displaced from, the first and second axes. The third arm is pivotably coupled with the base about a fourth axis that is parallel to, but displaced from, the first, second, and third axes. The second arm is configured to receive the shaft so that the axis of the shaft is configured to remain in a fixed orientation with respect to a plane that includes the second axis and the third axis. The linkage also includes a first biasing element coupled with the linkage so that the first biasing element is configured to apply a first force to the linkage that biases the linkage in a raising direction from the stowed position.

In some example embodiments, the trolling motor mount also includes a second biasing element coupled with the linkage so that the second biasing element is configured to apply a second force to the linkage that biases the linkage to move the trolling motor subassembly toward the stowed position. In some example embodiments, the second biasing element is coupled with the linkage so that the second biasing element is configured to apply the second force to the linkage only along a portion of a travel path of the trolling motor subassembly. In some example embodiments, the first biasing element is pivotably coupled with the first arm between the first and second axes and is pivotably coupled with the third arm between the third and fourth axes.

In some example embodiments, the trolling motor mount also includes a spring arm. The spring arm is pivotably coupled to the base about the fourth axis, the second biasing element is pivotably coupled with the spring arm about a fifth axis that is offset from the first, second, third, and fourth axes, and the second biasing element is pivotably coupled with the third arm between the third and fourth axes. In an example embodiment, the first biasing element is slidably coupled with the third arm.

In yet a further example embodiment, a trolling motor mount is provided for movably coupling a trolling motor subassembly to a marine vessel so that the trolling motor subassembly is movable between a stowed position and a deployed position. A motor of the trolling motor subassembly is configured to be submerged in a body of water when the trolling motor subassembly is in the deployed position and the motor of the trolling motor subassembly is configured to be out of the body of water when the trolling motor subassembly is in the stowed position. The trolling motor includes a shaft having an axis. The trolling motor mount includes a base and a linkage that is configured to couple the trolling motor subassembly to the base. The linkage includes a first arm having a first end and a second end. The first end of the first arm is coupled with the base. The linkage also includes a bidirectional biasing structure including a first biasing element coupled with the linkage so that the first biasing element is configured to apply a first force to the linkage to bias the linkage in a raising direction from the stowed position and a second biasing element coupled with the linkage so that the second biasing element is configured to apply a second force to the linkage to bias the linkage to move the trolling motor subassembly from the deployed position.

The above referenced summary section is provided to introduce a selection of concepts in a simplified form that are further described below in the detailed description section. The summary is not intended to identify key features or essential features of the claimed subject matter, nor is it intended to be used to limit the scope of the claimed subject matter. Moreover, the claimed subject matter is not limited to implementations that solve any or all disadvantages noted in any part of this disclosure.

BRIEF DESCRIPTION OF THE DRAWINGS

Figure 1:
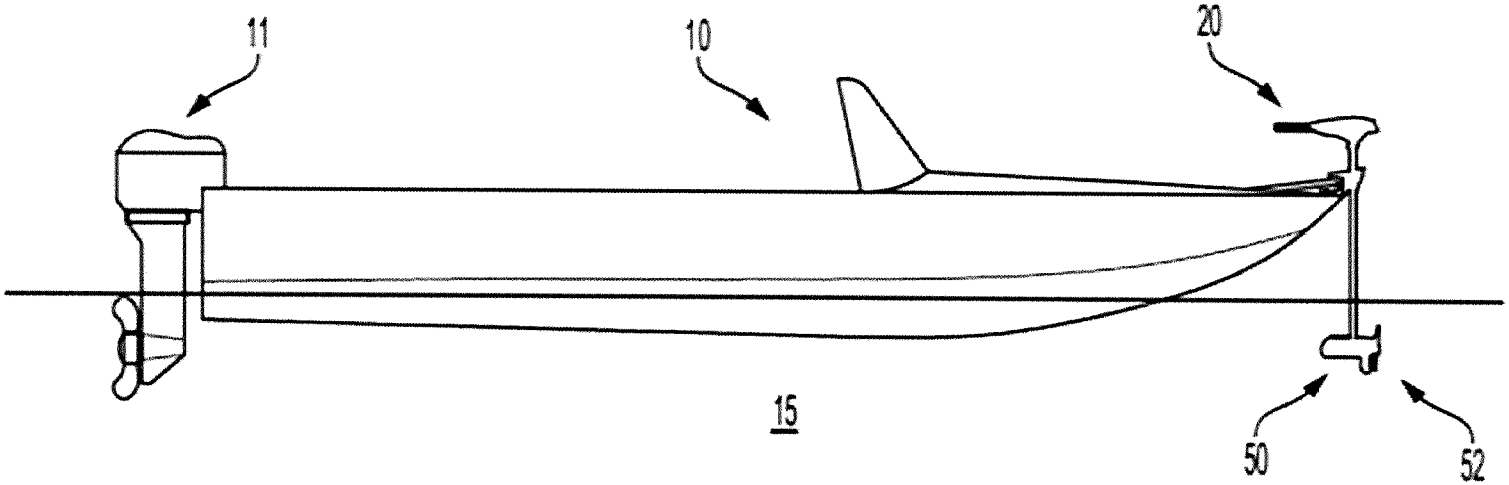
Figure 2:
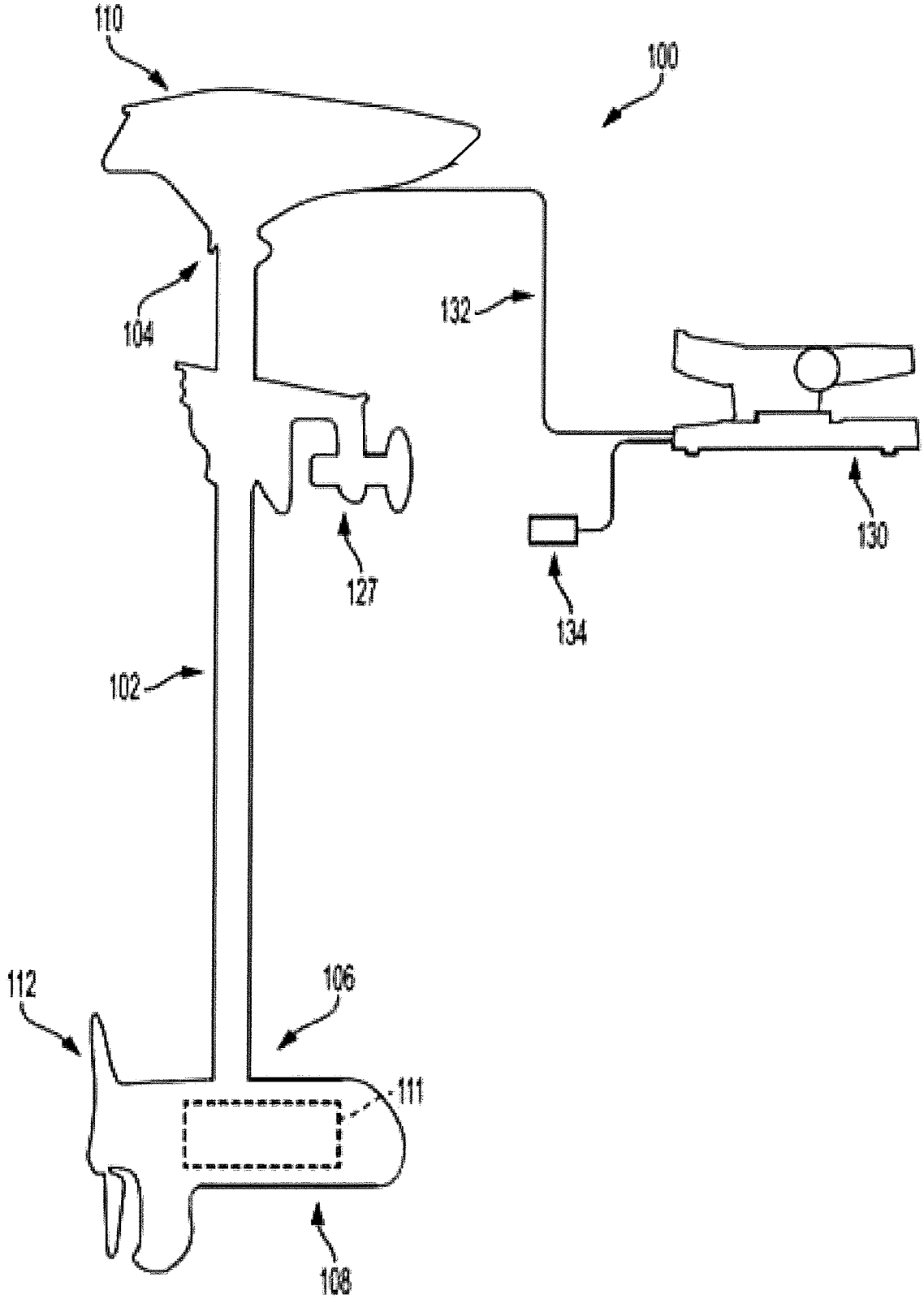
Figure 3:
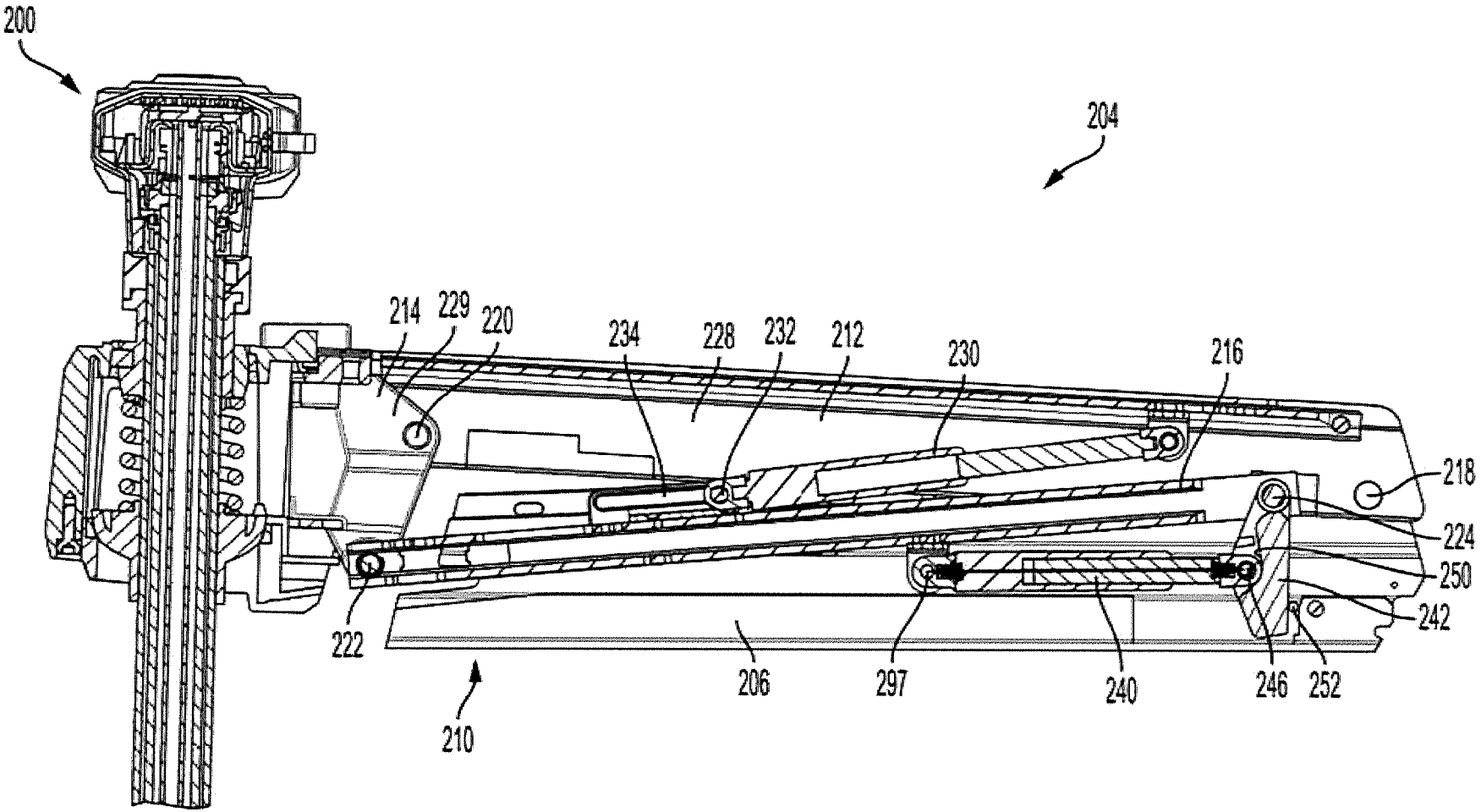
Figure 4:
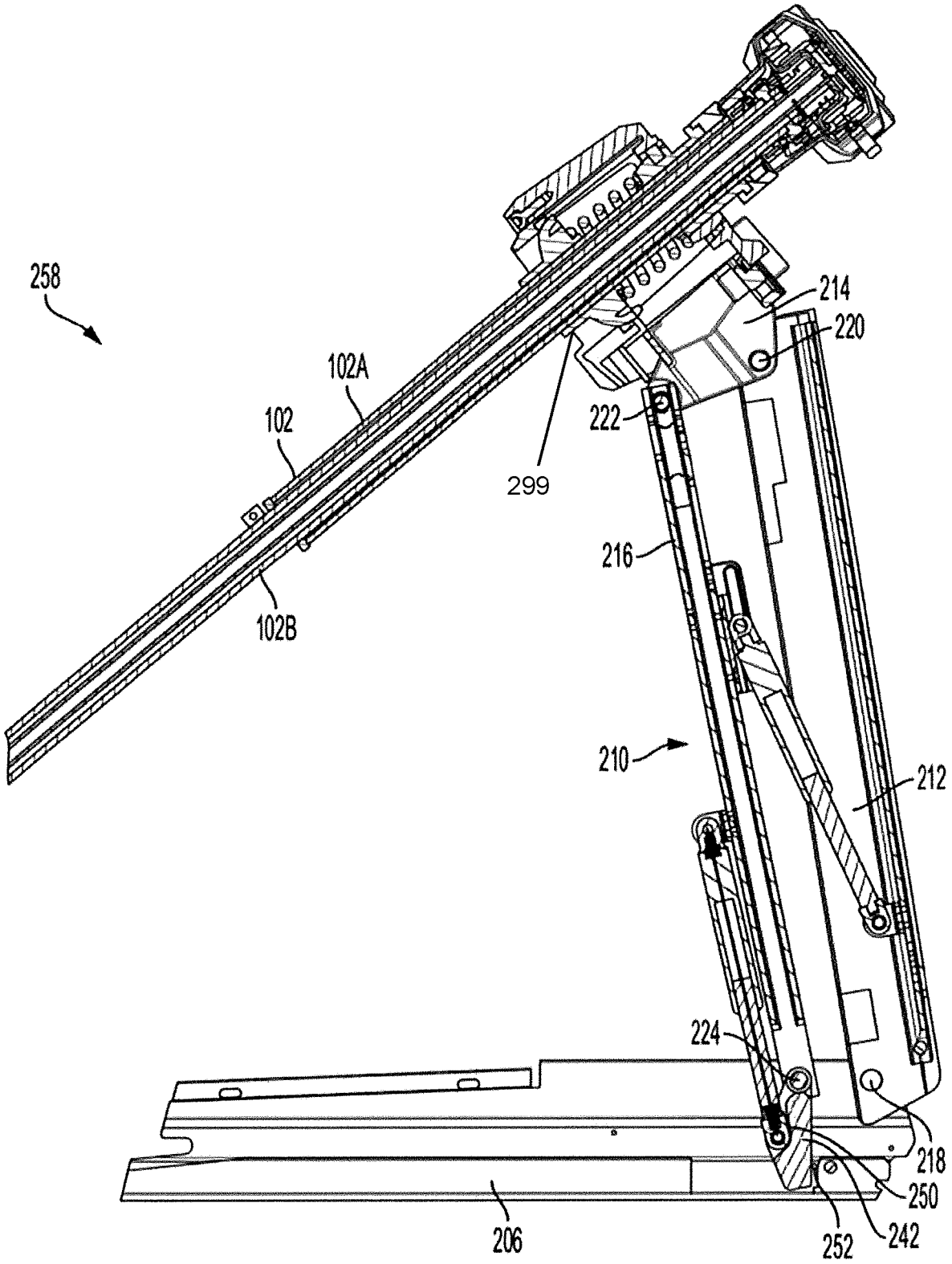
Figure 5:
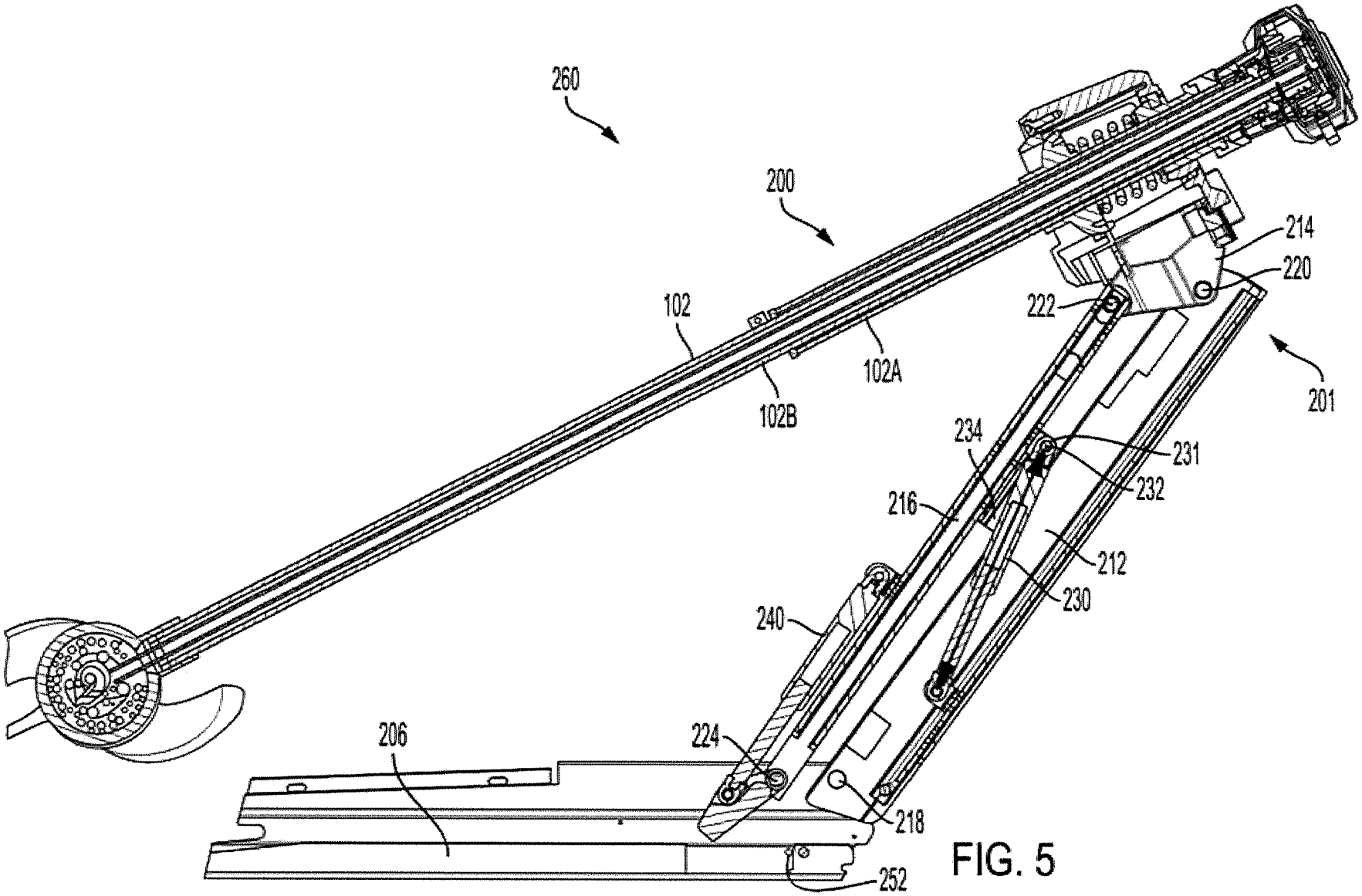
Figure 6:
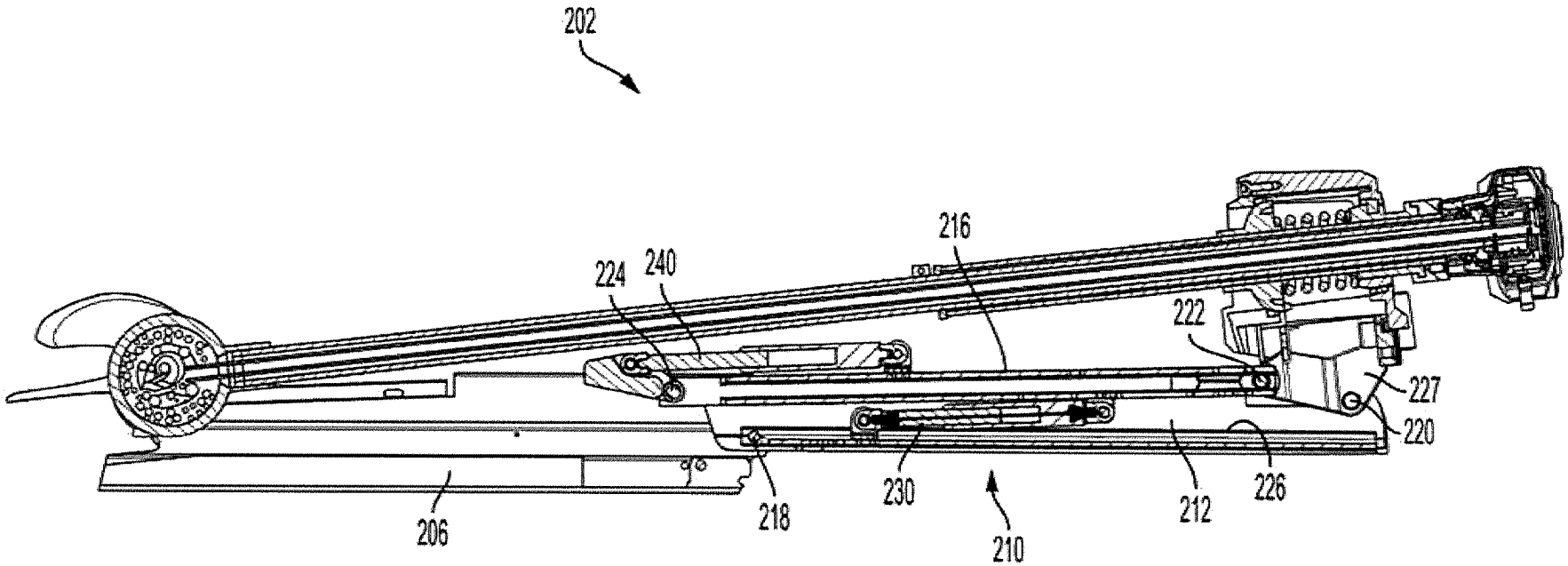
Figure 7:
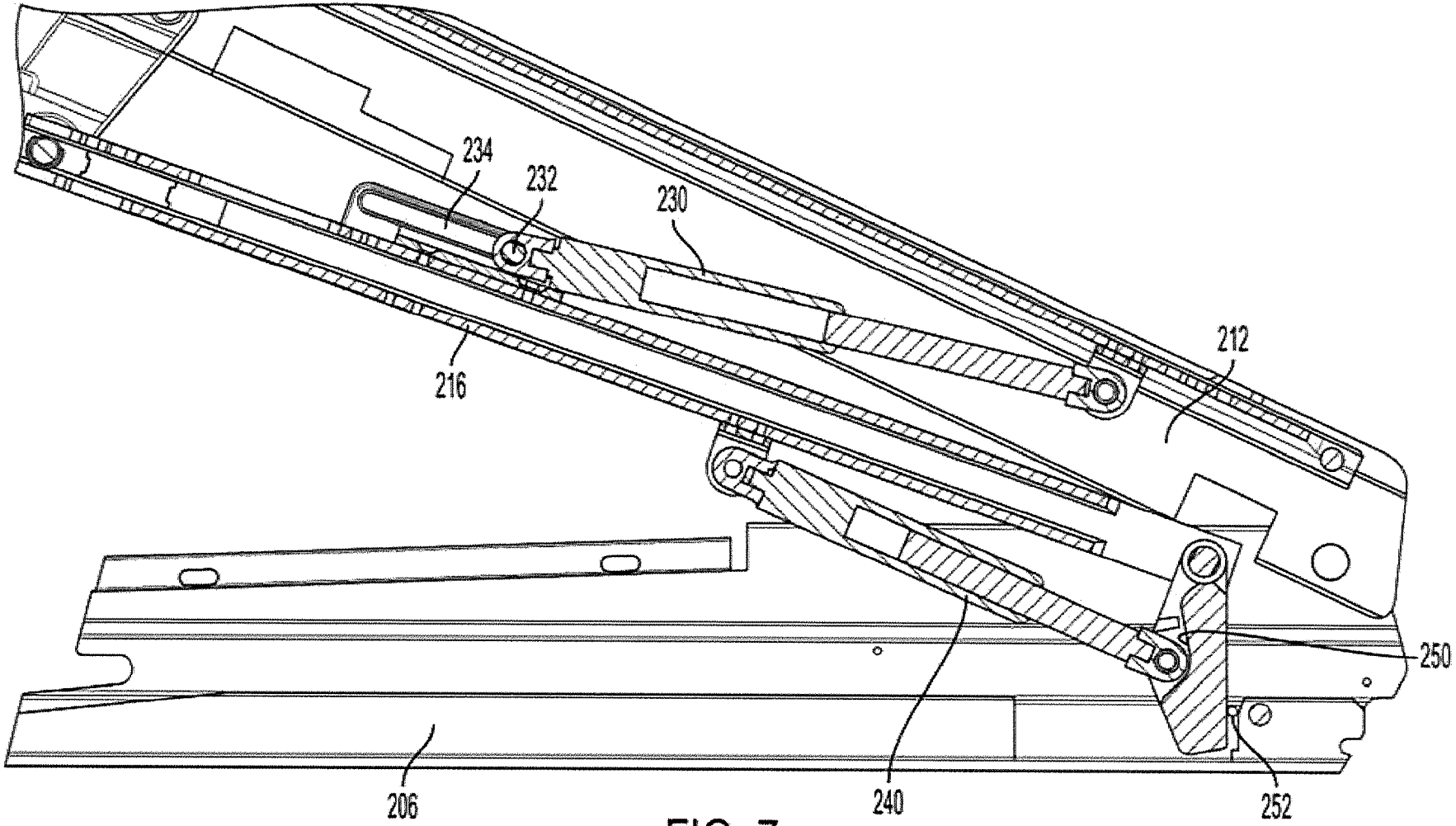
Figure 8:
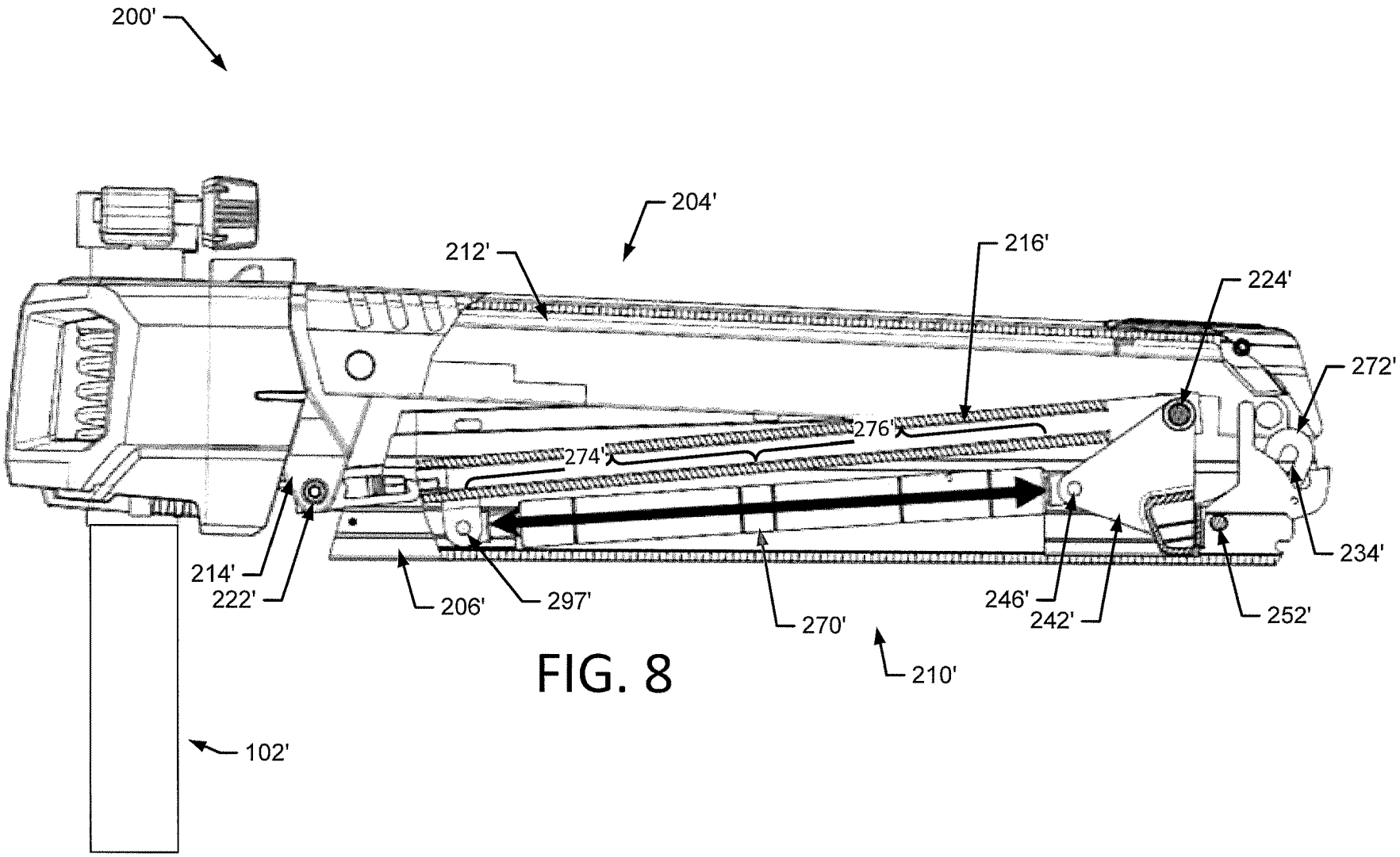
Figure 9:
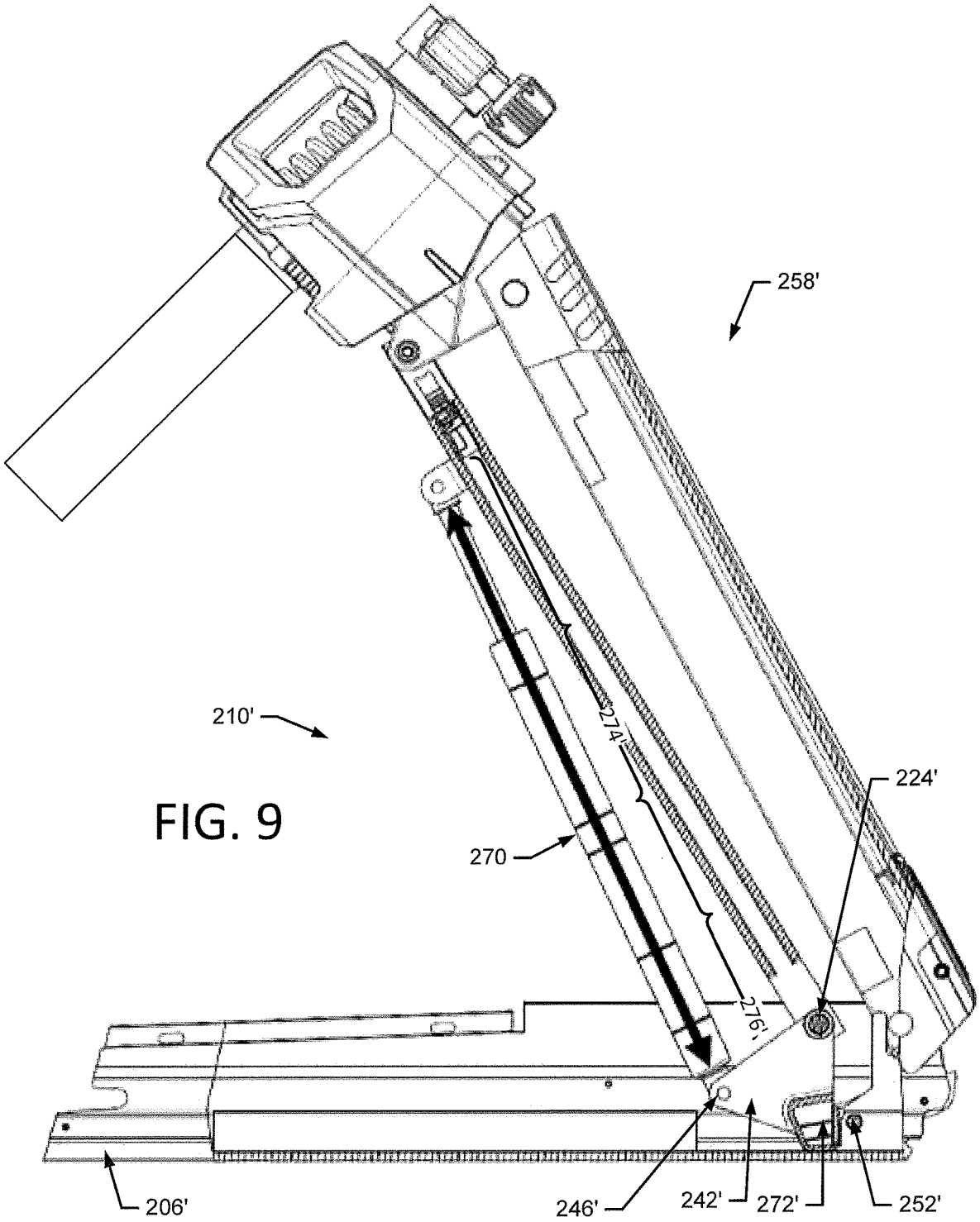
Figure 10:
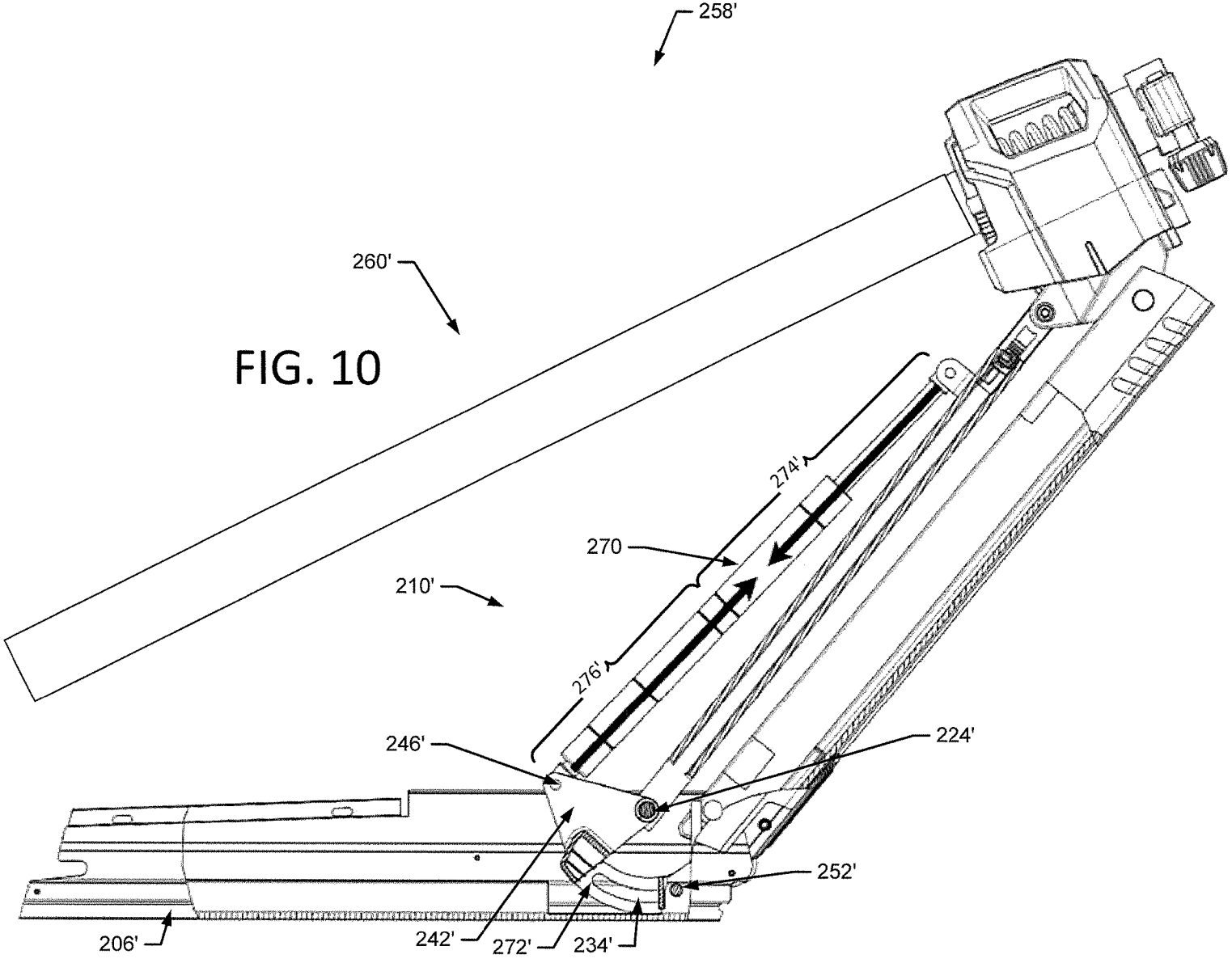
Figure 11:
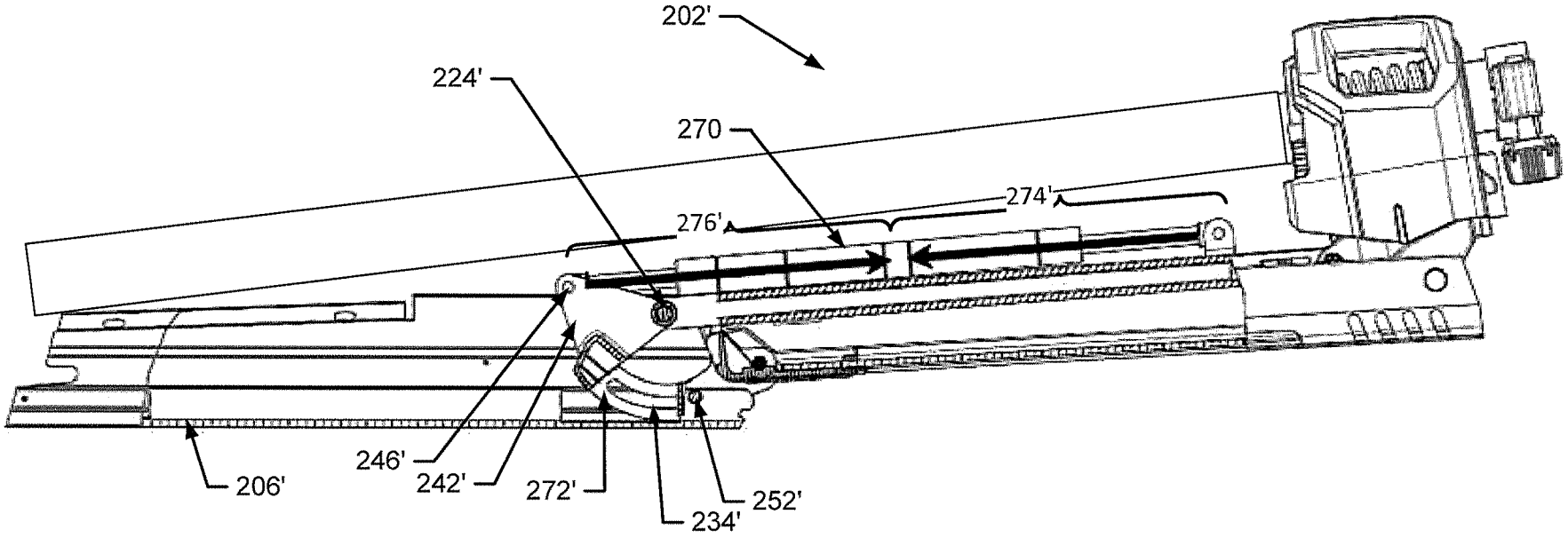

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 shows an example trolling motor assembly, in accordance with some embodiments discussed herein;

FIG. 3 shows a cross sectional side view of a trolling motor assembly, including a linkage, in a deployed state, in accordance with some embodiments discussed herein;

FIG. 4 shows a cross sectional view of the trolling motor assembly shown in FIG. 3, in a second intermediate state, in accordance with some embodiments discussed herein;

FIG. 5 shows a cross sectional side view of the trolling motor assembly shown in FIGS. 3-4, in a first intermediate state, in accordance with some embodiments discussed herein;

FIG. 6 shows a cross sectional side view of the trolling motor assembly shown in FIGS. 3-5, in a stowed state, in accordance with some embodiments discussed herein;

FIG. 7 shows a close up partial cross sectional side view of the trolling motor assembly shown in FIGS. 3-6, in a third intermediate state, in accordance with some embodiments discussed herein;

FIG. 8 shows a cross sectional side view of a trolling motor assembly, including a linkage, in a deployed state, in accordance with some embodiments discussed herein;

FIG. 9 shows a cross sectional view of the trolling motor assembly shown in FIG. 8, in a second intermediate state, in accordance with some embodiments discussed herein;

FIG. 10 shows a cross sectional side view of the trolling motor assembly shown in FIGS. 8-9, in a first intermediate state, in accordance with some embodiments discussed herein; and FIG. 11 shows a cross sectional side view of the trolling motor assembly shown in FIGS. 8-10, in a stowed state, in accordance with some embodiments discussed herein.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein. Rather, these embodiments are provided so that this disclosure will satisfy applicable legal requirements. Like reference numerals refer to like elements throughout.

FIG. 1 illustrates an example watercraft 10 on a body of water 15. The watercraft 10 has a propulsion motor assembly 20 attached to its front, with a trolling motor 50 submerged in the body of water. According to some example embodiments, the trolling motor assembly 20 may include the propulsion motor 50, a propeller 52, and a navigation control device used to control the speed and the course or direction of propulsion. The trolling motor assembly 20 may be attached to the bow of the watercraft 10 and the propulsion motor 50 and propeller 52 may be submerged in the body of water. However, positioning of the trolling motor assembly 20 need not be limited to the bow and may be placed elsewhere on the watercraft 10. The trolling motor assembly 20 can be used to propel the watercraft 10, such as when fishing and/or when wanting to remain in a particular location despite the effects of wind and currents on the watercraft 10. Depending on the design, the propeller 52 of a trolling motor assembly may be driven by a gas-powered engine or an electric motor. Moreover, steering the trolling motor assembly 20 may be accomplished manually via hand control or via foot control or electrically via remote control and/or via the foot pedal. While FIG. 1 depicts the trolling motor assembly 20 as being a secondary propulsion system to the main engine 11, example embodiments described herein contemplate that the trolling motor assembly 20 may be the primary propulsion system for the watercraft 10.

FIG. 2 illustrates an example trolling motor assembly 100 that is electric and may be controlled with a foot pedal assembly 130. The trolling motor assembly 100 includes a shaft 102 defining a first end 104 and a second end 106, a trolling motor housing 108, and a main housing 110. The trolling motor housing 108 is attached to the second end 106 of the shaft 102 and at least partially contains a propulsion motor 111, or trolling motor, that connects to a propeller 112. As shown in FIG. 1, in some embodiments, when the trolling motor assembly is attached to the watercraft 10 and the propulsion motor 111 (or trolling motor housing) is submerged in the water, the propulsion motor is configured to propel the watercraft to travel along the body of water. In addition to containing the propulsion motor 111, the trolling motor housing 108 may include other components such as, for example, a sonar transducer assembly and/or other sensors or features (e.g., lights, temperature sensors, etc.).

The main housing 110 is connected to the shaft 102 proximate the first end 104 of the shaft 102 may include a hand control rod 114 that enables control of the propulsion motor 111 by a user (e.g., through angular rotation) although the foot pedal assembly 130 is the preferred method of controlling the operation of the trolling motor assembly 100 for some embodiments described herein. As shown in FIG. 1, in some embodiments, when the trolling motor assembly is attached to the watercraft and the propulsion motor 111 is submerged in the water, the main housing 110 is positioned out of the body of water and visible/accessible by a user. The main housing 110 may be configured to house components of the trolling motor assembly, such as may be used for processing marine data and/or controlling operation of the trolling motor, among other things. For example, depending on the configuration and features of the trolling motor assembly, the trolling motor assembly 100 may contain, for example, one or more of a processor, a sonar assembly, memory, a communication interface, an autopilot navigation assembly, a speed actuator, and a steering actuator for the propulsion motor 111.

Referring to FIG. 2, as noted, in some embodiments, the trolling motor assembly 100 includes a foot pedal assembly 130 that is electrically connected to the propulsion motor 111 (such as through the main housing 110) using a cable 132 (although it could be connected wirelessly). The foot pedal assembly 130 may enable a user to steer and/or otherwise operate the trolling motor assembly 100 to control the direction and speed of travel of the watercraft. Further, depending on the configuration of the foot pedal assembly, the foot pedal assembly 130 may include an electrical plug 134 that can be connected to an external power source.

The trolling motor assembly 100 may also include an attachment device 127 (e.g., a clamp, a mount, or a plurality of fasteners) to enable connection or attachment of the trolling motor assembly 100 to the watercraft. Depending on the attachment device used, the trolling motor assembly 100 may be configured for rotational movement relative to the watercraft about the shaft's axis, including, for example, 360 degree rotational movement.

Referring to FIGS. 3-7, the attachment device may include a linkage that enables a portion of the trolling motor assembly 100 to be movable between a stowed position 202 (shown in FIG. 6) and a deployed position 204 (shown in FIG. 3). For example, a trolling motor subassembly 200 that includes the shaft 102, the motor 111, and, in some embodiments, some components of the linkage may be pivotable with respect to a base 206. The base 206 may be configured to be attached to the marine vessel (e.g., via clamps or fasteners). When the trolling motor assembly is in the stowed state, it may be in an orientation in which the motor is out of the water, and the shaft 102 may be generally horizontal (e.g., within twenty degrees of horizontal). When the trolling motor subassembly 200 is in the deployed state, the motor 111 may be positioned below the base 206 when the base is horizontal and the trolling motor assembly is in its normally intended operational orientation, as shown in FIG. 2. When the base 206 is attached to the marine vessel 10 (FIG. 1) and the trolling motor subassembly 200 is in the deployed state, the trolling motor 111 may be submerged in the water.

In some embodiments, the trolling motor subassembly 200 may connect to the marine vessel 10 (FIG. 1) by a linkage 210, which may be, for example, a four bar linkage. The linkage 210 may include the base 206, a first arm 212, a second arm 214, and a third arm 216. With reference to FIGS. 3 and 4, the first arm 212 may pivotably attach to the base 206 about a first axis 218. The first arm 212 may pivotably attach to the second arm 214 about a second axis 220. The second arm 214 may pivotably attach to the third arm 216 about a third axis 222. The third arm 216 may pivotably attach to the base 206 about a fourth axis 224.

The linkage 210 may be configured so that the first arm 212 is pivotable approximately 180 degrees from a first horizontal orientation 226 (FIG. 6) to a second horizontal orientation 228 (FIG. 3). The linkage may further be configured so that a full pivoting of the first arm 212 from the first horizontal orientation 226 to the second horizontal orientation 228 causes the second arm to travel from a first position 227 (FIG. 6) to a second position 229 (FIG. 3) that is approximately a ninety degree rotation, plus or minus twenty degrees, from the first position 227. Accordingly, the trolling motor subassembly 200, which includes the elements of the trolling motor assembly 100 that are pivotable with respect to the base 206, may further include a first arm 212, a second arm 214, and a third arm 216.

While each of the first, second, and third arms may be linear bars (or equivalent structure), it should be understood that the arms are not limited to such a configuration. For example, the second arm 214 may comprise a coupling (e.g., a trolling motor subassembly mount 299) between the shaft 102 and the linkage 210. In some embodiments, the second arm may include a clamp 215 that engages an exterior of the shaft 102. The clamp may releasably couple with the shaft so that when the clamp is in a released state, the shaft is slidable about its axial dimension with respect to the second arm 214. In this way, when the subassembly 200 is in its deployed position, the motor may be vertically shifted (e.g., in a raising and a lowering direction). Shaft 102 may comprise an inner shaft 102B that is pivotable within an outer shaft 102A. In this way, the outer shaft 102A may be non-pivotably held in the clamp 215 while the inner shaft 102B rotate therein so that the trolling motor 111 may rotate with respect to the shaft's axis.

A first biasing element 230 (e.g., a linear gas spring) may bias the linkage 210, and therefore, the subassembly 200 in a direction from the stowed position 202 to the deployed position 204. That is, the first biasing element 230 may provide a force that corresponds with a torque in a raising direction from the stowed position 202. The first biasing element 230 may couple with the first arm 212 at a fixed axis along the first arm's length between the first axis 218 and the second axis 220 (see e.g., FIG. 5). The first biasing element 230 may pivotably couple with the third arm 216 about an axis 232 that is disposed between the third axis 222 and fourth axis 224. In some embodiments, the first biasing element 230 may couple with the third arm 216 about a pin 231 that is slidable within a slot 234 (shown well in FIG. 5). That is, the axis 232 may travel along a portion of the length of the third arm 216 between the third axis 222 and the fourth axis 224. In this way, and as described further herein, the first biasing element 230 may provide a biasing force on the linkage for only a portion of the linkage's travel between the stowed position and the deployed position.

A second biasing element 240 may bias the linkage 210, and, therefore, the subassembly 200 in a direction from the deployed position 204 to the stowed position 202. That is, the second biasing element 240 may provide a force that corresponds with a torque in a raising direction from the deployed position 204. The second biasing element 240 (e.g., a linear gas spring) may pivotably attach at a first end to the third arm 216 about an axis 297 between the third axis 222 and the fourth axis 224. The second biasing element 240 may pivotably attach at a second end about a fifth axis 246 to a spring arm 242. The spring arm 242 may pivotally attach to the linkage 200 at the fourth axis 224. The linkage may include a stop 252 that engages an edge of the spring arm 242, thereby preventing the spring arm 242 from pivoting about the fourth axis 224 beyond a desired pivotal range. The spring arm 242 may have a stop surface 250 that engages an edge of the second biasing element 240, thereby restricting the pivotal range between the second biasing element 240 and the spring arm 242. Once the biasing element 240 engages the stop surface 250, the biasing element 240 ceases to apply a force to the linkage. In this way, biasing element 240 may provide a force that results in a torque being applied to the linkage 210 in the raising direction from the deployed position 204 along only a portion of its travel between the stowed position and the deployed position.

Accordingly, as the subassembly 200 travels between the deployed position 204 and the stowed position 202, the linkage 210 may receive spring forces along its path. Between the deployed position 204 and a first intermediate position 258 (as shown in FIG. 4), at which point second biasing element 240 engages the stop surface 250, the second biasing element may apply a spring force to the linkage 210 that biases the subassembly 200 in a raising direction from the deployed position. In some embodiments, this spring force is less than the force from the weight of the sub assembly 200 and linkage 210, and therefore, additional force is required to move the linkage 210 in a raising direction from the deployed position. Accordingly, this spring force reduces the force required from a user to move from the deployed position to the first intermediate position. In some embodiments, the linkage may be configured so that the force that biasing element 240 applies to the linkage 210 increases from the first intermediate position to the deployed position 204. Moreover, the same spring force resists movement from the first intermediate position to the deployed position 204, thereby damping the subassembly's approach to the deployed position. Between the deployed position 204 and the first intermediate position 258, axis 232 travels along slot 234 so that the biasing element 230 remains fully extended. Accordingly, the biasing element 230 applies no force to the linkage 210 along this portion of the subassembly's travel.

The linkage may travel from the first intermediate position 258 to a second intermediate position 260 (as shown in FIG. 5), at which point the axis 232 reaches an end of the slot 234. Between the first intermediate position and the second intermediate position, neither the first biasing element 230 nor the second biasing element 240 acts on the linkage. At the second intermediate position, the first biasing element 230 begins applying a force to resist the travel of the linkage in the direction from the second intermediate position 260 to the stowed position 202. Accordingly, the spring force from the first biasing element 230 counteracts the moment on the subassembly 200 due to gravity and slows the rate at which the subassembly 200 approaches the stowed position 202, thereby inhibiting the subassembly 200 from reaching the stowed position at a jarring rate. Further, when moving the subassembly 200 from the stowed position to the second intermediate position, the first biasing element 230 reduces the amount of force required by a user to lift the subassembly 200 (e.g., the first biasing element provides a force that biases the linkage in a raising direction from the stowed position).

In some embodiments, as can be seen in FIG. 6, the first biasing element 230 may be a linear spring that connects between the first arm 212 and the third arm 216. In the illustrated embodiment, because the distance between (a) the location of the coupling of the first biasing element 230 and the third arm and (b) the third arm's pivotal axis about the base is greater than the distance between (c) the location of the coupling of the first biasing element 230 and the first arm 212 and (d) the first arm's pivotal axis about the base, the torque applied to the linkage is always counterclockwise with respect to FIGS. 5-6. However, in the illustrated embodiment, the first biasing element 230 connects to the first and third arms so that in the stowed position, the first biasing element 230 applies a force that is generally in a radial direction to the first arm 212 and third arm 216 with respect to the respective pivotal axes 218, 224 at which the respective arms pivot with respect to the base 206. Accordingly, in this position, the spring provides little torque to move the linkage 210. In this way, gravity holds the subassembly 200 in the stowed position 202. As can be seen in FIG. 5, as the user moves the subassembly 200 from the stowed position, the biasing element 240 applies its spring force in an increasingly radial amount to the third arm 216 with respect to its pivotal axis 224 about the base 206. Accordingly, the increasingly radial component of the spring force applied to the third arm corresponds with an increasing torque on the linkage. Thus, the first biasing element 230 can allow the subassembly 200 to stay in the stowed position, yet provide an increasing lifting assistance to the user as the subassembly 200 moves from the stowed position.

FIGS. 8-11, depict another example trolling motor subassembly 200' configured to move the trolling motor 100 between a deployed position 204' (Shown in FIG. 8) and a stowed position 202' (shown in FIG. 11). The subassembly 200' may be substantially similar to the subassembly 200 described above in reference to FIGS. 3-7. However, instead of the first biasing element 230 and second biasing element 240, the subassembly 200' includes a bidirectional biasing structure 270'. The bidirectional biasing structure 270' may provide both the force corresponding with a torque in the raising direction from the stowed position 202' and the force corresponding with a torque in the raising direction from the deployed position 204'. In some embodiments, the bidirectional biasing structure 270' may pivotally attach at a first end to the third arm 216' about axis 297' between the third axis 222' and the fourth axis 224'. The bidirectional biasing structure 270' may be pivotally attached at a second end about the fifth axis 246' to a spring arm 242'.

The bidirectional biasing structure 270' may comprise a first biasing element 274', e.g. first linear gas spring, and a second biasing element 276', e.g. second linear gas spring. The first biasing element 274' may be coupled to the second biasing element 276' by a common cylinder housing, coupled cylinder housings, or other suitable configurations, such that a piston of each of the first biasing element and the second biasing elements extend from opposing ends of the bidirectional biasing structure 270'. A piston of the first biasing element 274' may be attached to axis 297' and a piston of the second biasing element 276' may be connected to axis 246'. The first biasing element 274' may be biased toward an extended piston position and the second biasing element 276' may be biased toward a retracted or inserted piston position. In the deployed position 204', the first biasing element 274' and the second biasing element 276' may be in the retracted position. In the stowed position 202', the first biasing element 274' and the second biasing element 276' may be in the extended piston position (shown in FIG. 11).

In some embodiments, the spring arm 242' may include a slot 234' (such as shown in FIG. 10). The spring arm 242' may couple with the base 206 about a pin 252' that is slidable within a slot 234' (shown well in FIGS. 10 and 11). That is, the pin 252' may travel along the slot between the first intermediate position 258' (shown in FIG. 9) and the second intermediate position 260' (shown in FIG. 10). In this way, and as described further herein, the bidirectional biasing structure 270' may provide a biasing force on the linkage for only a portion of the linkage's travel between the stowed position 202' and the deployed position 204' (e.g., bias is not applied by the bidirectional biasing structure between the first intermediate position 258' and the second intermediate position 260', as the pin 252' travels along slot 234'). In the depicted embodiment, the spring arm 242' includes a pivot arm 272'. The slot 234' may be disposed in the pivot arm 272'. In an example embodiment, the pivot arm 272' and slot 234' disposed therein may be curved, such that the slot 234' forms a travel arc about axis 224'. The subassembly 200' may pivot about axis 224' with no spring force applied by the single biasing element 270', while the pin 252' is traveling along slot 234'. When the pin 252' engages either end of the slot 234' a spring force may be applied by the single biasing element 270'. As further described below, the bidirectional biasing structure 270' may provide a force to the linkage 210 in the raising direction from the deployed position 204' along only a portion of its travel between the stowed position and the deployed position. Similarly, the bidirectional biasing structure 270' may provide a force to the linkage 210' in the raising direction from the deployed position 204' along only a portion of its travel between the deployed position 204' and the stowed position 202'.

As the subassembly 200' travels between the deployed position 204' and the stowed position 202', the linkage 210' may receive spring forces along its path. Between the deployed position 204' (shown in FIG. 8) and a first intermediate position 258' (as shown in FIG. 9), the first biasing element 274' of the bidirectional biasing structure 270' may apply a spring force to the linkage 210' that biases the subassembly 200' in a raising direction from the deployed position 204', as the piston extends to the extended position, which causes decompressing of gas within the cylinder. In some embodiments, this spring force is less than the force from the weight of the subassembly 200' and linkage 210', and therefore, additional force is required to move the linkage 210' in a raising direction from the deployed position 204'. Accordingly, this spring force reduces the force required from a user to move from the deployed position to the first intermediate position 258'. In some embodiments, the linkage 210' may be configured so that the force that the first biasing element 274' of the bidirectional biasing structure 270' applies to the linkage 210' increases from the first intermediate position 258' to the deployed position 204', as the piston is inserted to the retracted piston position, which causes compressing of gas within the cylinder. Moreover, the same spring force resists movement from the first intermediate position 258' to the deployed position 204', thereby damping the subassembly's approach to the deployed position 204'.

Between the first intermediate position 258' (shown in FIG. 9) and the second intermediate position 260' (shown in FIG. 10), the sub assembly 200' may pivot about axis 224'. Pivoting of the linkage 210' may cause the bidirectional biasing structure 270' to apply a force to the spring arm 242' causing the spring arm 242' to rotate. Between the first intermediate position 258' and the second intermediate position 260', neither the first biasing element of 274' of the bidirectional biasing structure 270' nor the second biasing element 276' of the bidirectional biasing structure 270' acts on the linkage 210'. The force required to pivot the linkage between the first intermediate position 258' and the second intermediate position 260' may be less than the force required to extend or compress the single biasing element 270'. Accordingly, the bidirectional biasing structure 270' applies no force to the linkage 210' along this portion of the subassembly's 200' travel. The pin 252' travels along slot 234' until the pin 252' engages a first end of the slot 234' at the second intermediate position 260' as the sub assembly 200' moves toward the stowed position 202' (e.g., shown in FIG. 10). Similarly, as the subassembly 200' moves toward the deployed position 204', the pin 252' travels along slot 234' until the pin engages a second end of the slot at the first intermediate position 258'.

At the second intermediate position 260', the second biasing element 276' begins applying a force to resist the travel of the linkage 210' in the direction from the second intermediate position 260' to the stowed position 202'. This force may be caused by the drawing a vacuum within the cylinder of the second biasing element 276', as the piston is extended. Accordingly, the spring force from the second biasing element 276' counteracts the moment on the subassembly 200' due to gravity and slows the rate at which the subassembly 200' approaches the stowed position 202', thereby inhibiting the subassembly 200' from reaching the stowed position 202' at a jarring rate. Further, when moving the subassembly 200' from the stowed position to the second intermediate position 260', the second biasing element 276' reduces the amount of force required by a user to lift the subassembly 200' (e.g., the second biasing element 276' provides a force that biases the linkage 210' in a raising direction from the stowed position).

In some embodiments, and as shown in the Figures, the first and second biasing elements 230, 240, 274', 276' may be linear gas springs. In various other embodiments, the first and/or second biasing elements may be other biasing elements, such as torsion springs, tension springs, or compression springs.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A trolling motor assembly comprising:

a trolling motor subassembly comprising:

a shaft comprising an axis, and a motor coupled with the shaft at a first end of the shaft, wherein, when attached to a watercraft on a body of water, the trolling motor subassembly is movable between a stowed position and a deployed position, wherein the motor of the trolling motor subassembly is configured to be submerged in the body of water when the trolling motor subassembly is in the deployed position, and wherein the motor of the trolling motor subassembly is configured to be out of the body of water when the trolling motor subassembly is in the stowed position;

a base;

a linkage coupling the trolling motor subassembly to the base, wherein the linkage comprises a first arm having a first end and a second end, wherein the first end of the first arm is coupled with the base;

a first biasing element coupled with the linkage so that the first biasing element is configured to apply a first force to the linkage that biases the linkage in a raising direction from the stowed position; and a slot, wherein the first biasing element is connected to a pin that moves within the slot such that the first biasing element does not provide a biasing force on the linkage between a first intermediate position and a second intermediate position along travel of the linkage as the trolling motor subassembly moves between the deployed position and the stowed position.

2. The trolling motor assembly of claim 1, wherein, when the base is coupled with a marine vessel and the trolling motor subassembly is in the stowed position, the shaft is generally horizontal, and wherein, when the base is coupled with the marine vessel and the trolling motor subassembly is in the deployed position, the shaft is generally vertical.

3. The trolling motor assembly of claim 1, further comprising a second biasing element coupled with the linkage so that the second biasing element is configured to apply a second force to the linkage that biases the linkage to move the trolling motor subassembly toward the stowed position.

4. The trolling motor assembly of claim 3, wherein the first biasing element and the second biasing element are coupled to form a bidirectional biasing structure.

5. The trolling motor assembly of claim 3, wherein the linkage further comprises:

a second arm; and a third arm;

wherein the first arm is pivotably coupled at a first end with the base about a first axis, wherein the first arm is pivotably coupled at a second end with the second arm about a second axis that is parallel to and displaced from the first axis, wherein the second end is opposite the first end, wherein the second arm is pivotably coupled with the third arm about a third axis that is parallel to, but displaced from, the first axis and the second axis, wherein the third arm is pivotably coupled with the base about a fourth axis that is parallel to, but displaced from, the first axis, the second axis, and third axis, and wherein the second arm is coupled with the shaft so that the axis of the shaft is configured to remain in a fixed orientation with respect to a plane that includes the second axis and the third axis, thereby coupling the shaft to the first arm.

6. The trolling motor assembly of claim 5, wherein the second biasing element is coupled with the linkage so that the second biasing element is configured to apply the second force to the linkage only along a portion of a travel path of the trolling motor subassembly.

7. The trolling motor assembly of claim 6, wherein the first biasing element is pivotably coupled with the first arm between the first axis and second axis and is pivotably coupled with the third arm between the third axis and fourth axis.

8. The trolling motor assembly of claim 7, further comprising a spring arm, wherein the spring arm is pivotably coupled to the base about the fourth axis, wherein the second biasing element is pivotably coupled with the spring arm about a fifth axis that is offset from the first axis, the second axis, the third axis, and the fourth axis, wherein the second biasing element is pivotably coupled with the third arm between the third axis and the fourth axis.

9. The trolling motor assembly of claim 8, wherein the first biasing element is slidably coupled with the third arm.

10. The trolling motor assembly of claim 9, wherein the first biasing element is slidably coupled with the third arm via a pivotable pin that is slidable within a slot.

11. The trolling motor assembly of claim 5, wherein the second arm comprises a trolling motor subassembly mount that pivotably and slidably receives the shaft of the trolling motor subassembly.

12. The trolling motor assembly of claim 3, wherein the second biasing element is a gas spring.

13. The trolling motor assembly of claim 1, wherein the first biasing element is a gas spring.

14. A trolling motor mount for movably coupling a trolling motor subassembly to a marine vessel so that the trolling motor subassembly is movable between a stowed position and a deployed position, wherein a motor of the trolling motor subassembly is configured to be submerged in a body of water when the trolling motor subassembly is in the deployed position, and wherein the motor of the trolling motor subassembly is configured to be out of the body of water when the trolling motor subassembly is in the stowed position, wherein the trolling motor comprises a shaft having an axis, and wherein the trolling motor mount comprises:

a linkage comprising:

a base;

a first arm having a first end and a second end;

a second arm; and a third arm, wherein the first arm is pivotably coupled at the first end with the base about a first axis, wherein the first arm is pivotably coupled at the second end with the second arm about a second axis that is parallel to and displaced from the first axis, wherein the second arm is pivotably coupled with the third arm about a third axis that is parallel to, but displaced from, the first axis and the second axis, wherein the third arm is pivotably coupled with the base about a fourth axis that is parallel to, but displaced from, the first axis, the second axis, and the third axis, and wherein the second arm is configured to receive the shaft so that the axis of the shaft is configured to remain in a fixed orientation with respect to a plane that includes the second axis and the third axis; and a first biasing element coupled with the linkage so that the first biasing element is configured to apply a first force to the linkage that biases the linkage in a raising direction from the stowed position.

15. The trolling motor mount of claim 14, further comprising a second biasing element coupled with the linkage so that the second biasing element is configured to apply a second force to the linkage that biases the linkage to move the trolling motor subassembly toward the stowed position.

16. The trolling motor mount of claim 15, wherein the second biasing element is coupled with the linkage so that the second biasing element is configured to apply the second force to the linkage only along a portion of a travel path of the trolling motor subassembly.

17. The trolling motor mount of claim 14, wherein the first biasing element is pivotably coupled with the first arm between the first axis and the second axis and is pivotably coupled with the third arm between the third axis and the fourth axis.

18. The trolling motor mount of claim 17, further comprising a spring arm, wherein the spring arm is pivotably coupled to the base about the fourth axis, wherein the second biasing element is pivotably coupled with the spring arm about a fifth axis that is offset from the first axis, the second axis, the third axis, and the fourth axis, wherein the second biasing element is pivotably coupled with the third arm between the third axis and the fourth axis.

19. The trolling motor mount of claim 14, wherein the first biasing element is slidably coupled with the third arm.

20. A trolling motor mount for movably coupling a trolling motor subassembly to a marine vessel so that the trolling motor subassembly is movable between a stowed position and a deployed position, wherein a motor of the trolling motor subassembly is configured to be submerged in a body of water when the trolling motor subassembly is in the deployed position, and wherein the motor of the trolling motor subassembly is configured to be out of the body of water when the trolling motor subassembly is in the stowed position, wherein the trolling motor comprises a shaft having an axis, and wherein the trolling motor mount comprises:

a base;

a linkage that is configured to couple the trolling motor subassembly to the base, wherein the linkage comprises:

a first arm having a first end and a second end, wherein the first end of the first arm is coupled with the base; and a bidirectional biasing structure comprising:

a first biasing element coupled with the linkage so that the first biasing element is configured to apply a first force to the linkage to bias the linkage in a raising direction from the stowed position; and a second biasing element coupled with the linkage so that the second biasing element is configured to apply a second force to the linkage to bias the linkage to move the trolling motor subassembly from the deployed position; and a slot, wherein the bidirectional biasing structure is connected to a pin that moves within the slot such that the first biasing element and the second biasing element do not provide a biasing force on the linkage between a first intermediate position and a second intermediate position along travel of the linkage as the trolling motor subassembly moves between the deployed position and the stowed position.

* * * * *